US006173454B1

(12) United States Patent
Alvarez

(10) Patent No.: US 6,173,454 B1
(45) Date of Patent: Jan. 16, 2001

(54) JONNI SAFE

(76) Inventor: Dennis Alvarez, 311 Taghkanic Churchtown Rd., Craryville, NY (US) 12521

( * ) Notice: Under 35 U.S.C. 154(b), the term of this patent shall be extended for 0 days.

(21) Appl. No.: 09/492,248

(22) Filed: Jan. 27, 2000

(51) Int. Cl.[7] ..... A47K 13/14
(52) U.S. Cl. ..... 4/242.1; 4/253
(58) Field of Search ..... 4/242.1, 253, 236, 4/240, 235, 239, 237; 220/328, 327, 246; 292/DIG. 2

(56) References Cited

U.S. PATENT DOCUMENTS

| | | | | |
|---|---|---|---|---|
| 622,383 | * | 4/1899 | O'Brien . | |
| 1,800,715 | * | 4/1931 | Clausen . | |
| 2,744,264 | * | 5/1956 | Sperzel . | |
| 2,804,630 | * | 9/1957 | Gould | 4/239 |
| 2,852,786 | * | 9/1958 | Reinhard . | |
| 4,145,771 | | 3/1979 | Khazin | 4/253 |
| 4,221,431 | * | 9/1980 | Rose | 4/661 |
| 4,296,504 | | 10/1981 | Lawson | 4/253 |
| 4,395,784 | | 8/1983 | Foster | 4/236 |
| 4,479,273 | | 10/1984 | Raden et al. | 4/253 |
| 4,502,167 | | 3/1985 | Porzelius | 4/253 |
| 4,561,130 | | 12/1985 | Bumgardner et al. | 4/253 |
| 4,724,551 | | 2/1988 | Gardner | 4/253 |
| 4,736,472 | | 4/1988 | Buckshaw et al. | 4/253 |
| 5,003,641 | | 4/1991 | Selman, Jr. | 4/253 |
| 5,191,991 | * | 3/1993 | Jackson | 220/207 |
| 5,347,663 | | 9/1994 | Yost | 4/253 |
| 5,560,049 | | 10/1996 | Robinson et al. | 4/253 |
| 5,581,824 | | 12/1996 | Crook, Sr. | 4/253 |
| 5,636,389 | * | 6/1997 | LaLonde | 4/242.1 |
| 5,669,081 | | 9/1997 | Scherer et al. | 4/253 |
| 5,842,234 | * | 12/1998 | Dixon | 4/235 |
| 5,867,843 | | 2/1999 | Robello et al. | 4/246.1 |
| 5,937,449 | | 8/1999 | Rey | 4/246.1 |

OTHER PUBLICATIONS

Toilet Lid Lock, "safetymatters.com/online store," Item #: B–240.

Potty Lock, "safetymatters.com/online store," Item #:B–400.

* cited by examiner

*Primary Examiner*—Henry J. Recla
*Assistant Examiner*—Khoa Huynh
(74) *Attorney, Agent, or Firm*—Heslin & Rothenberg, P.C.

(57) ABSTRACT

A safety device for restricting access into the open interior portion of a toilet bowl is disclosed. The safety device may be used with any conventional toilet unit having a hinged toilet seat and lid combination. The safety device comprises a pair of compression springs and a safety lid having a first end configured to overlay the open interior portion of the toilet bowl and a second end configured to overlay the distal connecting portion of the toilet bowl. The second end of the safety lid is further configured to include a pair of slots that are positioned for engagement with the mounting screws of the hinge mechanism of the toilet seat and lid combination.

3 Claims, 3 Drawing Sheets

JONNI SAFE

FIELD OF THE INVENTION

This invention relates to a safety device and method for restricting access into the open interior portion of a toilet bowl.

BACKGROUND OF THE INVENTION

Typically, toilet seat lids are readily opened, providing easy access into the interior of the toilet bowl. For sanitary and safety reasons, it is often the case that such easy access by restricted or prevented.

It is well known that an exposed toilet bowl can create an attractive hazard to a small child. Not only does the open bowl create an intriguing depository for any number of small items, it also creates a pool of water into which a child can crawl or slip into with tragic results. In addition to the drowning hazard, serious injury may also result from ingestion of the bowl water as poisonous chemicals are often used to maintain a sanitary condition in the bowl. An exposed toilet bowl can also provide a similar hazard to household pets, such as cats or dogs, which are often drawn to the bowl as a source of drinking water. Even when the toilet lid is in the down or closed position, toddlers as well as large pets are able to raise the lid in order to access the water in the interior of the bowl.

In addition, there are also circumstances whereby it is desirable for hygienic and sanitary reasons, to deny access to the open interior portion of the toilet bowl should the lid be lifted. For example, the toilet unit may be inoperable, the water line may be clogged, the water supply may be turned off, or the toilet unit may be in a model home and not connected to functioning sanitary services. In these instances, simply restraining the lifting of the toilet lid would not be effective, and it would be desirable to also block access to the interior of the bowl once the lid has been lifted.

Numerous different designs for toilet seat lid and toilet seat locks are known in the art. Typical designs frequently involve variations on a hinge-like unit adapted to be installed along the edge of the bowl and overlap the seat and lid. Such units are described, for example in U.S. Pat. Nos. 5,669,081; 4,736,472; 4,502,167; 4,479,273; 4,395,784 and 4,145,771, which describe variations of a lock unit that is mounted on an outer surface of the rim portion of the bowl and includes an elongated cover retaining element that extends over the outer surface of the toilet seat cover.

U.S. Pat. No. 4,561,130 describes a toilet seat cover safety latch that replaces the hinge portion of the toilet seat lid and provides resistance to the lifting of the lid. U.S. Pat. No. 5,560,049 describes a toilet seat safety device that comprises a cloth wrapping that covers a portion of the front of the seat lid, seat and toilet bowl and is secured behind the rear portion of the bowl. U.S. Pat. No. 5,581,824 describes a rigid housing member having an interior cavity that is contoured to fit over the toilet seat and bowl unit.

U.S. Pat. Nos. 5,937,449 and 4,296,504 describe different variations of a locking member located on the interior surface of the toilet seat lid which are adapted to engage the inner rim of the toilet seat and a receiving member affixed to the interior of the toilet bowl, respectively. U.S. Pat. No. 5,867,843 describes an automatic toilet seat closing apparatus that operates on a controlled release of air.

Most of the known locking devices, however, contain one or more features that have prevented their general acceptance and wide spread use. Many are complex, unsightly, expensive to produce, difficult to install and hard to keep clean and sanitary. In addition, many of the known toilet safety devices require alteration of some portion of the toilet unit itself, or require unsightly attachments or accessories.

Moreover, while the known devices provide many different means for denying access to the interior of a toilet bowl by restricting the lifting of a toilet seat lid, none of these devices provides this safety feature should the toilet seat lid be lifted.

The principles of the present invention provide a device that securely blocks access to the open interior portion of the toilet bowl even when the lid is lifted. The principles of the present invention may be readily applied to any style toilet unit without any alteration or modification of the toilet seat, the toilet seat lid, the toilet bowl, or the toilet water flush tank. The device is simple to install and use, easy to clean, inexpensive to manufacture and requires little or no maintenance to retain its effectiveness.

SUMMARY OF THE INVENTION

The principles of the present invention provide a safety device and method for restricting access into the open interior portion of a toilet bowl. The present invention accomplishes this by securely blocking access into the open interior portion of the toilet bowl even when the lid is lifted. The principles of the present invention may be readily adapted for use in conjunction with any style toilet unit that includes a standard hinged toilet seat and lid combination.

The safety device is comprised of a pair of compression springs and a safety lid having a first end configured to overlay the open interior portion of a toilet bowl and a second end configured to overlay the distal connecting portion of the toilet bowl and to include a pair of slots therein. The slots are positioned for alignment with the mounting screws that attach the toilet seat and lid to the distal connecting portion of the toilet bowl. As the safety lid may be readily configured in any shape or size, numerous embodiments of the invention will become readily apparent from the following detailed description of the preferred embodiment, the accompanying drawings and the appended claims.

DETAILED DESCRIPTION OF PREFERRED EMBODIMENTS

Although this invention is susceptible to embodiment in many different forms, preferred embodiments of the invention are shown. It should be understood, however, that the present disclosure is to be considered as a exemplification of the principles of this invention and is not intended to limit the invention to the embodiments illustrated.

Figure 1:
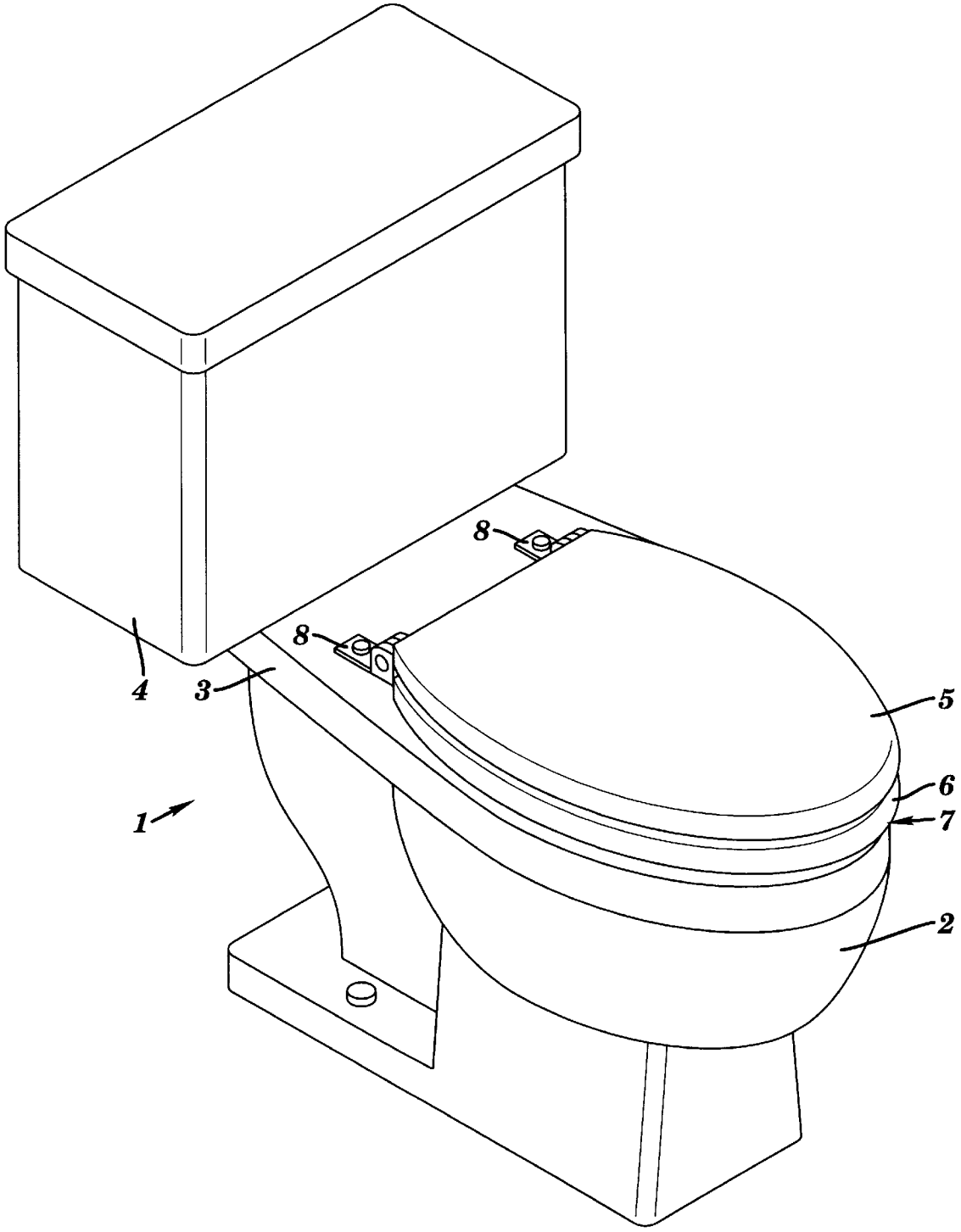
FIG. 1 is a schematic representation of a standard toilet unit.

As illustrated in FIG. 1, a standard toilet unit 1 comprises a toilet bowl base 2 having a distal connecting portion 3, a toilet water flush tank 4 mounted on and fluidly connected to the distal connecting portion 3 of the toilet bowl 2, and a toilet seat lid 5 and corresponding toilet seat 6 overlaying an open interior portion 7 of the toilet bowl 2.

Figure 2:
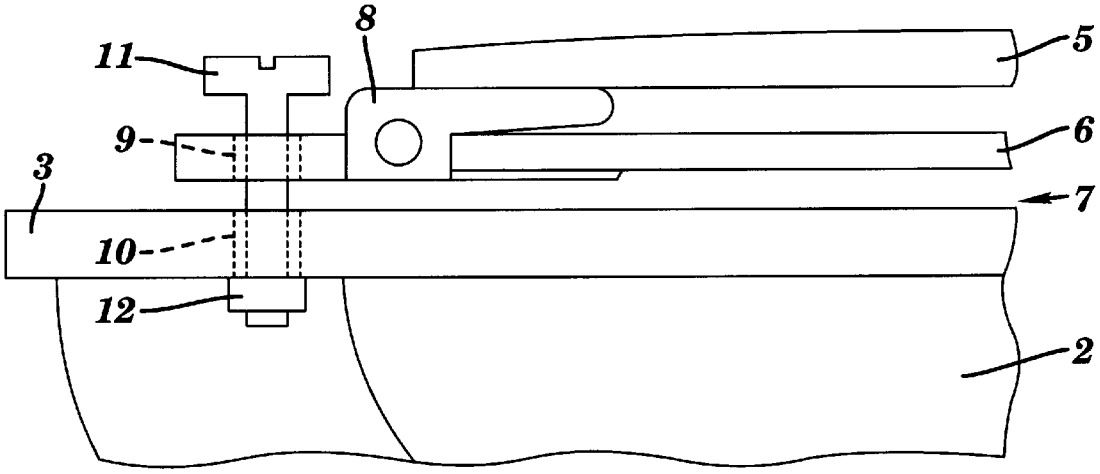
FIG. 2 is a schematic view of the point of attachment of the toilet lid and seat to the distal connecting portion of the toilet bowl.

As shown in FIG. 2, the toilet seat lid 5 and the toilet seat 6 are each pivotally mounted to the distal connecting portion 3 of the toilet bowl 2 by a pair of hinge mechanisms 8, each of which includes an aperture 9 that corresponds to one of a pair of apertures 10 in the distal connecting portion 3 of the toilet bowl 2. The hinge mechanism 8 of the toilet seat lid 5 and toilet seat 6 and the distal connecting portion 3 of the toilet bowl 2 are connected via a mounting screw 11, which passes through the corresponding apertures 9,10 in the hinge mechanism 8 and the distal connecting portion 3 of the toilet bowl 2 and is secured on the underside of the distal connecting portion 3 of the toilet bowl 2 with a mounting nut 12.

In operation, the toilet bowl base 2 will be installed upon a floor and be fluidly connected to a water supply such that toilet water flush tank 4 and the open interior portion 7 of the toilet bowl 2 are filled with water. Due to their hinged attachment to the distal connecting portion 3 of the toilet bowl 2, toilet seat lid 5 and toilet seat 6 may be lifted into a vertical position such that the water in the open interior portion 7 of the toilet bowl 2 is exposed.

Figure 3:
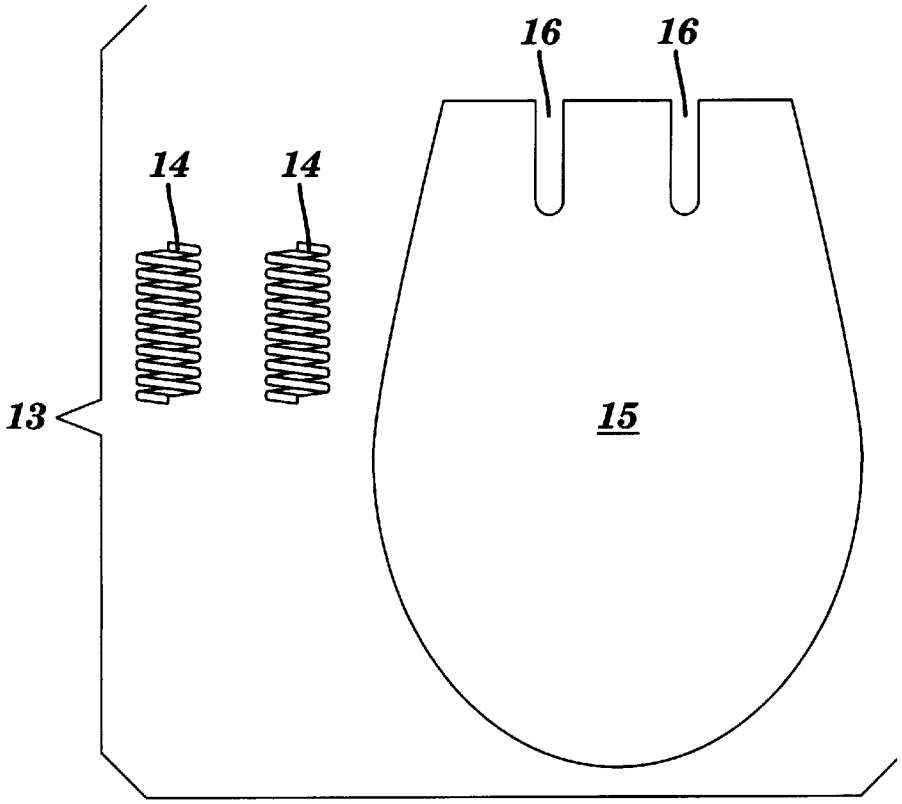
FIG. 3 is a schematic representation of a device of the present invention.

Referring now to FIG. 3, the safety device of the present invention 13, comprises a pair of compression springs 14 and a safety lid 15. As can be seen, safety lid 15 has a first end configured to overlay the open interior portion 7 of toilet bowl 2 and a second end configured to overlay the distal connecting portion 3 of toilet bowl 2. The second end of safety lid 15 is further configured to include a pair of slots 16 that correspond to the apertures 10 in the distal connecting portion 3 of toilet bowl 2. Safety lid 15 may be constructed of any sturdy material, such as for example, various vinyls, plastics, masonite, metal, woods, such as luon, and the like. For sanitary purposes, non-porous, washable materials are preferred.

To mount safety device 13 on the toilet unit 1, one has merely to remove mounting nuts 12; slide safety lid 15 under the toilet seat 6, thereby engaging slots 16 around mounting screws 11; place one of compression springs 14 on each of mounting screws 11; and replace mounting nuts 12.

Figure 4:
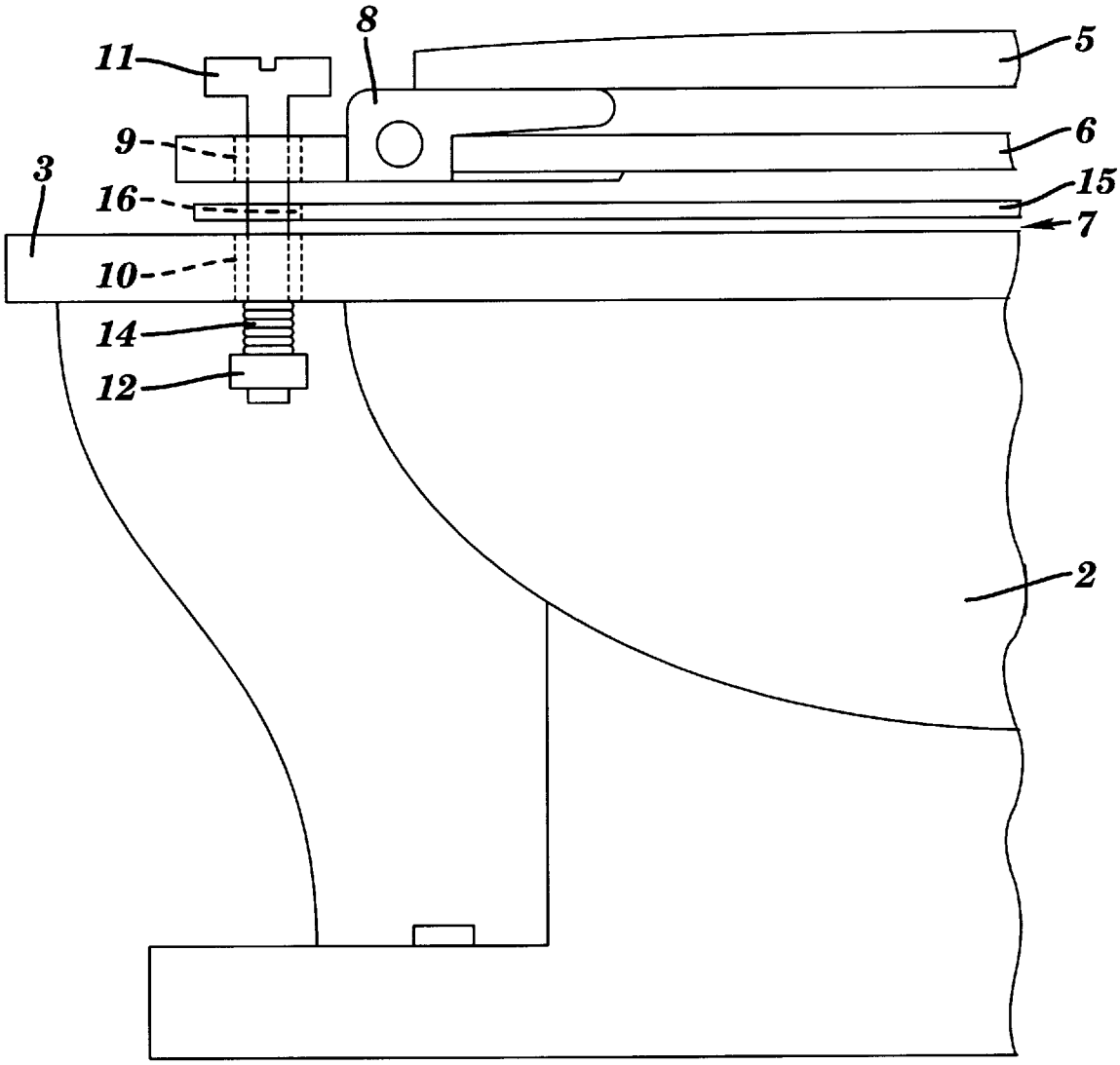
FIG. 4 is a schematic representation of the device of FIG. 3 in position on the standard toilet unit of FIG. 1.

FIG. 4 shows safety device 13 in place on a toilet unit. As can be seen, because safety lid 15 is not pivotally attached to the toilet unit, it may not be raised into a vertical position and securely blocks access to the open interior portion 7 of toilet bowl 2. Thus, even if toilet seat 6 and/or toilet seat lid 5 are lifted, the open interior portion 7 of the toilet bowl 2 remains blocked.

If it is the case, however, that it is desirable to access the interior portion 7 of toilet bowl 2, compression springs 14 and slots 16 allow safety lid 15 to be slidably disengaged from mounting screws 11 and removed from its active position. Compression springs 14 will expand to keep tension on mounting screws 11 when safety lid 15 has been removed. After the toilet unit has been used, safety lid 15 may be replaced to its active position by simply sliding it back over the open interior portion 7 of the toilet bowl 2 and engaging slots 16 about mounting screws 11. Due to the presence of compression springs 14, slots 16 may be engaged about mounting screws 11 without any manipulation of mounting nuts 12.

Compression springs 14 thus provide an adjustable level of tension on mounting screws 11 and safety lid 15 securely blocks access to the open interior portion 7 of the toilet bowl 2. If it is desired to access the open interior portion 7 of the toilet bowl 2, the safety lid 15 may be slidably removed and replaced with ease.

Accordingly, the principles of the present invention also provide for a method for restricting access to an open interior portion of a toilet bowl of a toilet unit which comprises mounting a safety device 13 on a toilet unit 1, whereby the safety lid 15 securely blocks access to the open interior portion 7 of the toilet bowl 2. The principles of the present invention further provide for kits for providing a safety toilet seat cover. The kits may be comprised of the safety device alone, or in combination with a standard hinged toilet seat and lid combination.

While this invention has been described in terms of specific embodiments, set forth in detail, it should be understood that these embodiments are presented by way of illustration only, and the invention is not necessarily limited thereto. As those skilled in the art will appreciate, modifications and variations within the spirit and scope of the claims that follow will be readily apparent from this disclosure.

I claim:

1. A safety device for restricting access to an open interior portion of a toilet bowl of a toilet unit, said toilet unit comprising a toilet bowl base having a distal connecting portion and an open interior portion, a toilet seat and a toilet seat lid, each of said toilet seat and said toilet seat lid being pivotally mounted on said distal connecting portion of said toilet bowl via a hinge mechanism including a pair of mounting screws, said safety device comprising:

a pair of compression springs for mounting on the mounting screws of said hinge mechanism; and a safety lid adapted to be mounted beneath said toilet seat, said safety lid having a first end configured to overlay and completely cover the open interior portion of the toilet bowl and a second end configured to overlay the distal connecting portion of the toilet bowl, said second end including a pair of slots positioned for sliding engagement with said pair of mounting screws, whereby upon engagement of the slots with the mounting screws, the second end of the safety lid overlays the distal connecting portion of the toilet bowl and the first end of the safety lid overlays and completely covers the open interior portion of the toilet bowl.

2. A kit for providing a safety toilet seat cover for use with a toilet unit, said kit comprising:

a toilet seat lid;

a toilet seat;

means for pivotally attaching said toilet seat lid and said toilet seat on a distal connecting portion of a toilet bowl of said toilet unit, with said toilet seat lid over said toilet seat;

a pair of compression springs; and a safety lid adapted to be mounted beneath said toilet seat and having a first end configured to overlay and completely cover an open interior portion of the toilet bowl and a second end configured to overlay the distal connecting portion of the toilet bowl, said second end including a pair of slots therein for cooperating with said compression springs to secure said safety lid on said bowl.

3. A method for restricting access to an open interior portion of a toilet bowl of a toilet unit, said toilet unit comprising a toilet bowl base having a distal connecting portion and an open interior portion, a toilet seat and a toilet seat lid, each of said toilet seat and said toilet seat lid being pivotally mounted on said distal connecting portion of said toilet bowl via a hinge mechanism including a pair of mounting screws, said method comprising:

providing a pair of compression springs and a safety lid adapted to be mounted beneath said toilet seat, said safety lid having a first end configured to overlay and completely cover the open interior portion of the toilet bowl and a second end configured to overlay the distal connecting portion of the toilet bowl, said second end including a pair of slots therein positioned for sliding engagement with said pair of mounting screws;

mounting said pair of compression springs on the mounting screws of said hinge mechanism; and engaging the slots in the distal end of said safety lid about said mounting screws, whereby the second end of the safety lid overlays the distal connecting portion of the toilet bowl and the first end of the safety lid overlays and completely covers the open interior portion of the toilet bowl.

* * * * *